US005445116A

United States Patent [19]

Hara

[11] Patent Number: 5,445,116

[45] Date of Patent: Aug. 29, 1995

[54] HYDRAULIC VARIABLE LIFT ENGINE VALVE GEAR

[75] Inventor: Seinosuke Hara, Atsugi, Japan

[73] Assignee: Unisia Jecs Corporation, Japan

[21] Appl. No.: 171,238

[22] Filed: Dec. 21, 1993

[30] Foreign Application Priority Data

| | | | |
|---|---|---|---|
| Dec. 22, 1992 | [JP] | Japan | 4-341740 |
| Jan. 22, 1993 | [JP] | Japan | 5-009161 |
| Feb. 3, 1993 | [JP] | Japan | 5-015777 |

[51] Int. Cl.[6] ..... F01L 1/18; F01L 1/24

[52] U.S. Cl. ..... 123/90.16; 123/90.17; 123/90.36; 123/90.43; 123/308

[58] Field of Search ..... 123/90.15, 90.16, 90.17, 123/90.27, 90.36, 90.39, 90.41, 90.43, 90.44, 308

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 4,762,096 | 9/1988 | Kamm et al. | 123/90.16 |
| 5,007,392 | 4/1991 | Nizzato et al. | 123/308 |
| 5,080,054 | 1/1992 | Nakamura | 123/90.16 |
| 5,183,015 | 2/1993 | Morita et al. | 123/90.16 |
| 5,203,289 | 4/1993 | Hara et al. | 123/90.16 |
| 5,239,952 | 8/1993 | Morita et al. | 123/90.16 |

FOREIGN PATENT DOCUMENTS

| | | |
|---|---|---|
| 4235934 | 4/1993 | Germany . |
| 63-57806 | 3/1988 | Japan . |
| 63-167016 | 7/1988 | Japan . |
| 2260784 | 4/1993 | United Kingdom . |

*Primary Examiner*—Henry C. Yuen
*Assistant Examiner*—Weilun Lo
*Attorney, Agent, or Firm*—Bachman & LaPointe

[57] ABSTRACT

A camshaft supported in an engine cylinder head structure has a low speed (lift) cam lobe and a high speed (lift) cam lobe. A rocker arm is supported by a hydraulic lash adjuster or a rocker shaft for pivotal motion and has a sub-rocker shaft and a pin. The rocker arm is drivingly engages the low lift cam lobe. A free cam follower is supported by the sub-rocker shaft and drivingly engages the high lift cam lobe. A latch lever supported by the pin has a latch position wherein one end portion of the latch lever is in locking engagement with the free cam follower and a latch release position wherein the one end portion of the latch lever is out of engagement with the free cam follower. A hydraulic piston received in bore is in driving engagement with the opposite end portion of the latch lever to urge the latch lever against a latch lever release spring towards the latch position thereof. Hydraulic fluid communication between the bore and a hydraulic fluid passage of the cylinder head structure is established through the hydraulic lash adjuster or the rocker shaft.

1 Claim, 12 Drawing Sheets

HYDRAULIC VARIABLE LIFT ENGINE VALVE GEAR

RELATED COPENDING APPLICATIONS

U.S. patent application Ser. No. 07/965,071, filed on Oct. 22, 1992, now U.S. Pat. No. 5,297,516;

British Patent Application No. 9222318.9, filed on Oct. 23, 1992, and published under No. 2 260 784 on Apr. 28, 1993;

German Patent Application No. P4235934.1, filed on Oct. 23, 1992, and published under No. 42 35 934 on Apr. 29, 1993.

BACKGROUND OF THE INVENTION

The present invention relates to a variable lift engine valve gear for an internal combustion engine.

Japanese Patent Application First (unexamined) Publications Nos. 63-57806 and 63-167016 disclose a valve actuating apparatus. The known valve actuating apparatus comprises a mechanism to releasably interconnect the adjacent two cam operated rocker arms. The rocker arms are formed with mating bores receiving a plunger. The plunger is movable between a first position in which the plunger is disposed in one of the mating bores and a second position in which the plunger is inserted into the other plunger and thus disposed in both of the mating bores. When the plunger is in the first position, the two rocker arms move separately, while when the plunger is in the second position, they move as a unit.

This mechanism using the plunger and mating bores, however, requires high degree of precision in forming the mating bores and the plunger.

It would be desirable to be able to provide a valve gear which does not use a plunger or bores which demand high degree of precision to form.

An object of the present invention is to propose an improved installation of variable lift valve gear in an internal combustion engine such that the number of solenoids required in controlling the shift in state of the valve gear is minimized.

SUMMARY OF THE INVENTION

The present invention provides an internal combustion engine, comprising:

a cylinder head structure;

a first cylinder valve mounted in said cylinder head structure;

first resilient means for biasing said first cylinder valve towards a closed position thereof;

a second cylinder valve mounted in said cylinder head structure;

second resilient means for biasing said second cylinder valve towards a closed position thereof;

said first and second cylinder valves being arranged for one cylinder of the engine;

a camshaft mounted for rotation in said cylinder head structure, said camshaft being rotatable about an axis;

a first rocker arm mounted in said cylinder head structure for pivotal motion to actuate said first cylinder valve against said first resilient means in response to rotation of said camshaft;

a first free cam follower supported by said first rocker arm for pivotal motion relative to said first rocker arm in response to rotation of said camshaft;

a first latch mechanism having a first position wherein said pivotal motion of said first free cam follower relative to said first rocker arm is prevented and a second position wherein said pivotal motion of said first free cam follower relative to said first rocker arm is allowed;

first hydraulic means for urging said first latch mechanism from said second position thereof towards said first position thereof;

a second rocker arm mounted in said cylinder head structure for pivotal motion to actuate said second cylinder valve against said second resilient means in response to rotation of said camshaft;

a second free cam follower supported by said second rocker arm for pivotal motion relative to said second rocker arm in response to rotation of said camshaft;

a second latch mechanism having a first position wherein said pivotal motion of said second free cam follower relative to said second rocker arm is prevented and a second position wherein said pivotal motion of said second free cam follower relative to said second rocker arm is allowed; and second hydraulic means for urging said second latch mechanism from said second position thereof towards said first position thereof.

The present invention also provides an internal combustion engine, comprising:

a cylinder head structure;

a first cylinder valve mounted in said cylinder head structure;

first resilient means for biasing said first cylinder valve towards a closed position thereof;

a second cylinder valve mounted in said cylinder head structure;

second resilient means for biasing said second cylinder valve towards a closed position thereof;

said first and second cylinder valves being arranged for one cylinder of the engine;

a camshaft mounted for rotation in said cylinder head structure, said camshaft being rotatable about an axis;

said cylinder head structure being formed with a lash adjuster mount bore;

a lash adjuster mounted in said lash adjuster mount bore, said lash adjuster including a moveable portion;

a rocker arm supported by said moveable portion of said hydraulic lash adjuster for pivotal motion to actuate said first and second cylinder valves against said first and second resilient means in response to rotation of said camshaft;

a free cam follower supported by said first rocker arm for pivotal motion relative to said first rocker arm in response to rotation of said camshaft;

a latch mechanism having a first position wherein said pivotal motion of said free cam follower relative to said rocker arm is prevented and a second position wherein said pivotal motion of said free cam follower relative to said rocker arm is allowed; and hydraulic means for urging said first latch mechanism from said second position thereof towards said first position thereof..

DETAILED DESCRIPTION OF THE INVENTION

Figure 3:
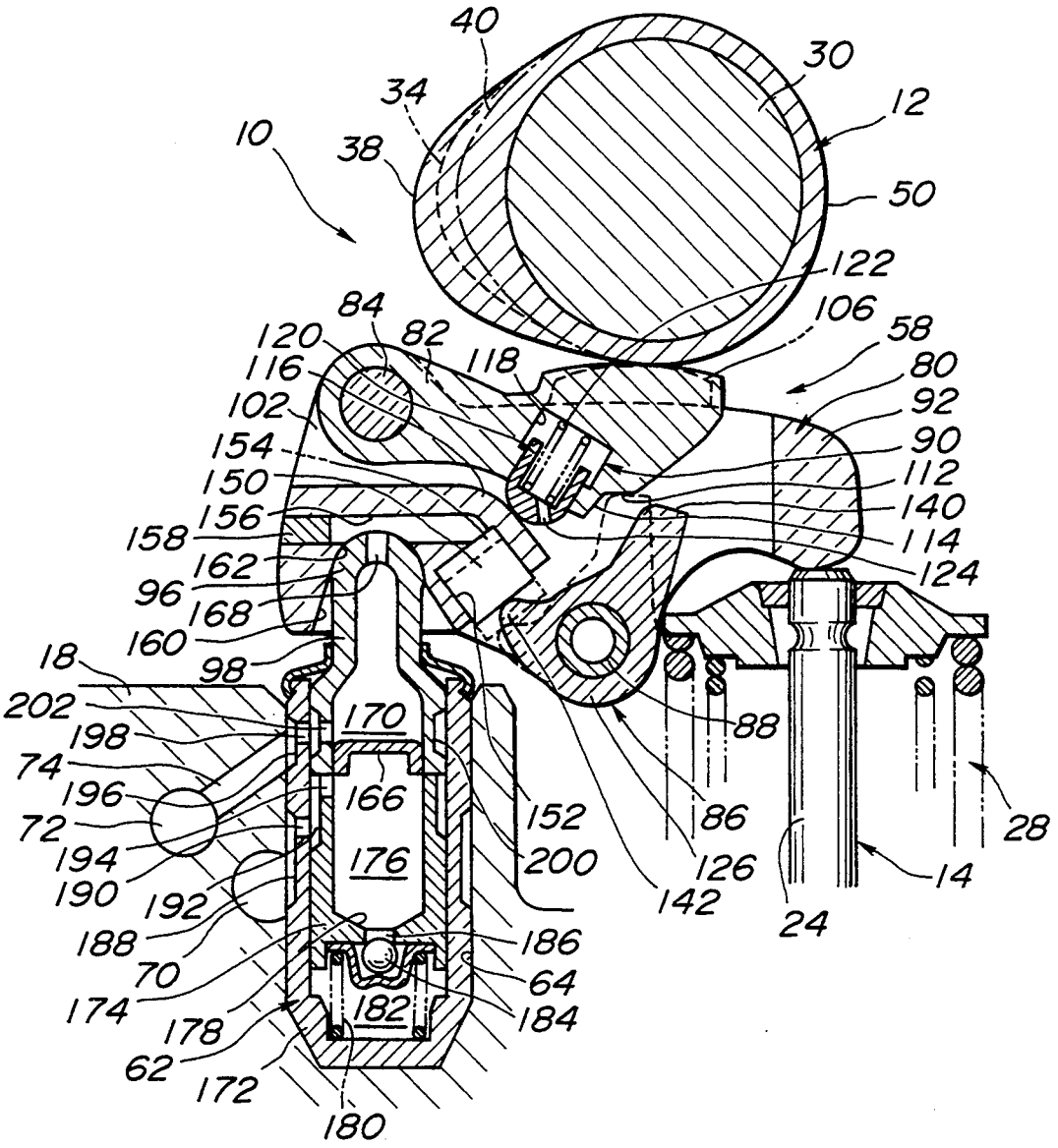
FIG. 3 is a fragmentary section of the engine cylinder head structure taken along the line 3—3 shown in FIG. 2.

Referring to FIG. 3, there is partially shown in cross section a cylinder head assembly of an internal combustion engine of the overhead camshaft type and a valve control mechanism 10 fit into a valve gear train portion 12. The internal combustion engine has four cylinder valves for each cylinder. The four cylinder valves include two intake valves and two exhaust valves.

Figure 1:
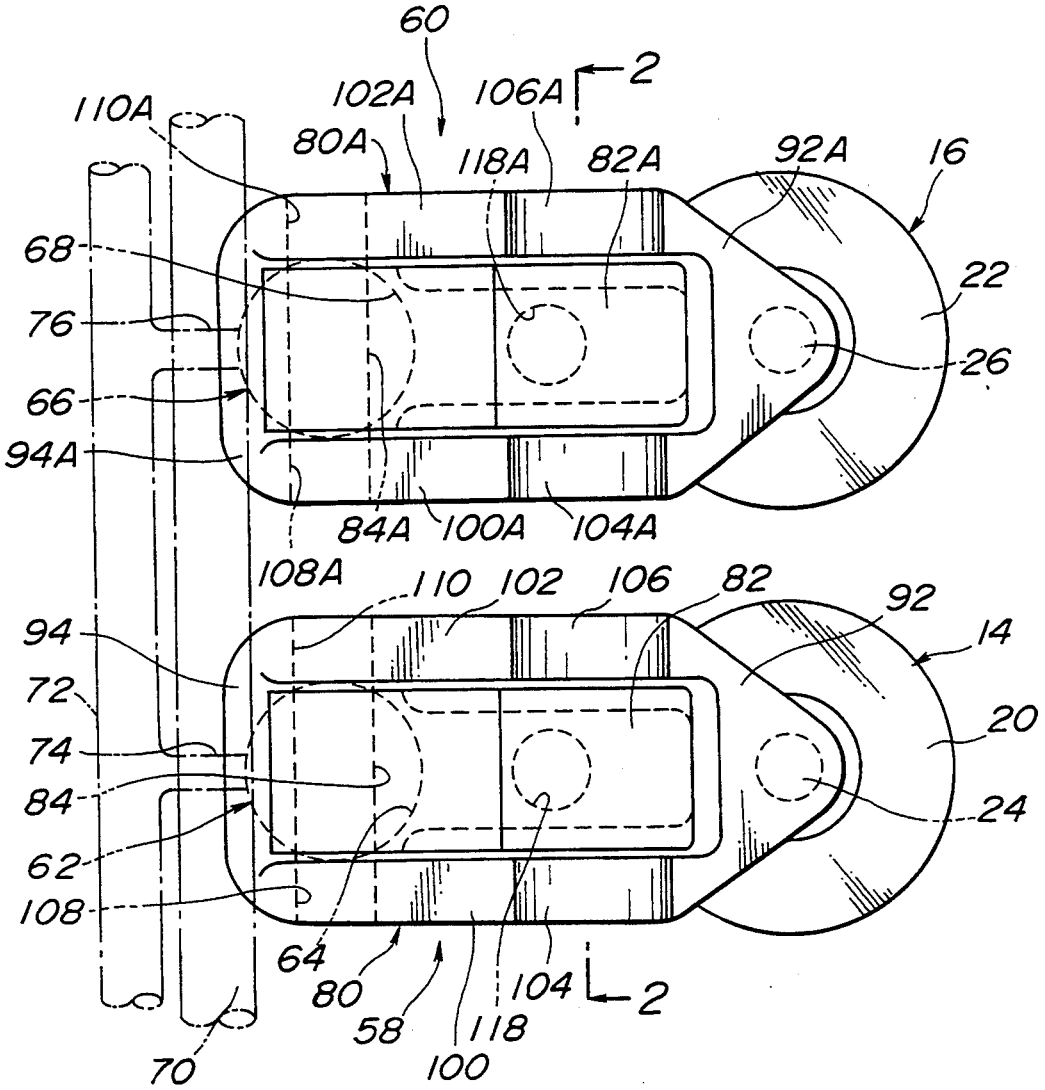
FIG. 1 is a top plan view of two valve rocker arms mounted in an internal combustion engine cylinder head structure to actuate two cylinder valves for one engine cylinder.

Referring to FIG. 1, there are shown two cylinder valves of the identical function which are arranged for one cylinder of the engine. The two cylinder valves are a first cylinder valve 14 and a second cylinder valve 16. The first and second cylinder valves 14 and 16 are mounted in a cylinder head structure, only a portion being shown at 18 in FIG. 3, in the conventional manner. The second cylinder valve 16 is of the same construction as the first cylinder valve 14.

Each of the valves 14 and 16 is of the poppet type. The valves 14 and 16 have valve head portions 20 and 22 and valve stem portions 24 and 26. As best seen in FIG. 3, the valve 14 is biased towards a closed position thereof by a spring assembly 28. The valve 16 is biased towards a closed position thereof by a spring assembly, not shown, in the same manner as the valve 14.

Figure 2:
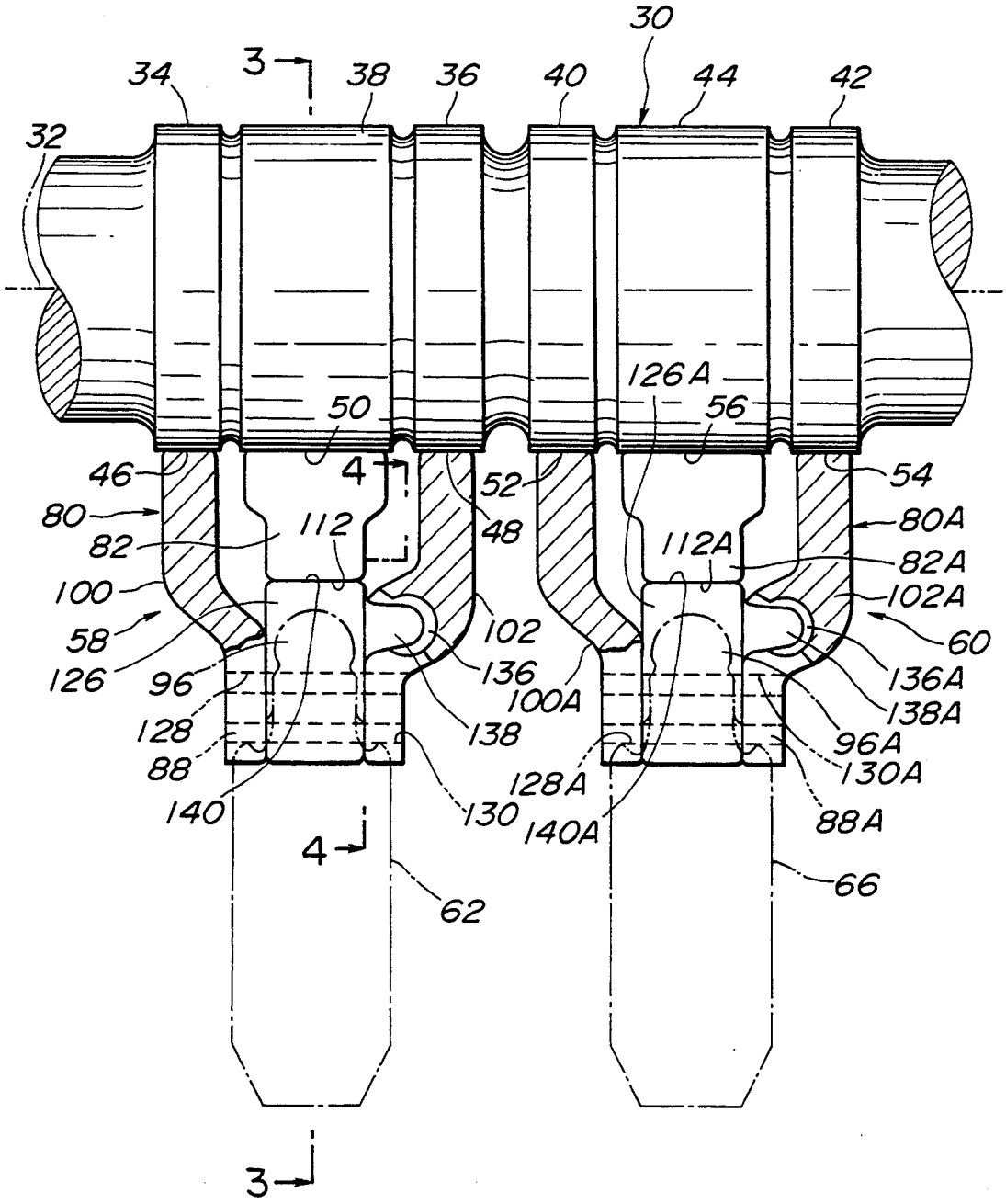
FIG. 2 is a section taken along the line 2—2 shown in FIG. 1 with a camshaft for driving the rocker arms.

Referring to FIGS. 2 and 3, a camshaft 30 is mounted in the conventional manner for rotation in the head structure. The camshaft 30 is rotatable about an axis 32 (see FIG. 2). The camshaft 30 has a first pair of axially spaced low lift cam lobes 34 and 36, and a first high lift cam lobe 38 axially disposed between the first pair of low lift cam lobes 34 and 36. It also has a second pair of axially spaced low lift cam lobes 40 and 42, and a second high lift cam lobe 44 axially disposed between the second pair of low lift cam lobes 40 and 42. The first pair of low lift cam lobes 34 and 36 project radially outward from cylindrical surface or dwell portions 46 and 48, while the first high lift cam lobe 38 projects radially outward from a cylindrical surface or dwell portion 50. All of the cylindrical surface portions 46, 48 and 50 have the identical radius and are concentric to the axis 32 of the camshaft 30, and define the base circles of the cam lobes 34, 36 and 38. Similarly, the second pair of low lift cam lobes 40 and 42 project radially outward from cylindrical surface or dwell portions 52 and 54, while the second high lift cam lobe 38 projects radially outward from a cylindrical surface or dwell portion 56. All of the cylindrical surface portions 46, 48 and 50 have the identical radius and are concentric to the axis 32 of the camshaft 30, and define the base circles of the cam lobes 40, 42 and 44.

The first and second high lift cam lobes 38 and 44 are for effecting a full opening of the first and second valves 14 and 16 during relatively high engine speed and loading. The first and second pairs of low lift cam lobes 34, 36 and 40, 42 are for effecting a partial opening of the first and second valves 14 and 16 during relatively low engine speed and loading. The first pair of low lift cam lobes 34 and 36 have identical height and circumferential positions with respect to each other, and the second pair of low lift cam lobes 40 and 42 have identical height and circumferential positions with respect to each other. However, the the second pair of low lift cam lobes 40 and 42 have the height lower than the height of the first pair of low lift cam lobes 34 and 36 and are completely confined within the circumferential and radial extent of the profile of the first pair of low lift cam lobes 34 and 36.

Referring back to FIG. 1, there are shown a first rocker arm 58 for actuating the valve 14 and a second rocker arm 60 for actuating the valve 16. As is readily seen from FIGS. 1 to 3, the first rocker arm 58 is pviotally supported at one end by a first hydraulic lash adjuster 62 contained in a first bore 64 defined in the head structure 18 (see FIG. 3), while the second rocker arm 60 is pivotally supported at one end by a second hydraulic lash adjuster 66 contained in a second bore 68 defined by the head structure 18.

The head structure 18 includes, in addition to the bores 64 and 68, a common hydraulic fluid passage 70 for supplying pressurized hydraulic fluid to the hydraulic lash adjusters 62 and 66, and a common hydraulic fluid passage 72 for supplying pressurized hydraulic fluid to or draining the first and second rocker arms 58 and 60 via respective branch passages 74 and 76.

The first and second rocker arms 58 and 60 have identical structure and mechanism with respect to each other and mounted in identical manner with respect to each other in the cylinder head structure 18 for pivotal motion to actuate the valves 14 and 16, respectively.

For brevity of description, the same reference numerals as used in denoting parts or portions of the first rocker arm 58 are used to denote identical parts or portions of the second rocker arm 60 but with a suffix A.

The rocker arm 58 includes an elongated rigid link 80, a free cam follower 82 pivotally hinged to the rigid link 80 at a position adjacent to the corresponding lash adjuster 62 by a pin 84, a latch mechanism 86 carried by a pin 88 at a position adjacent to the corresponding valve 14 and selectively operative to prevent pivotal movement of the free cam follower 82 relative to the link 80, a lost motion mechanism 90 for biasing the free cam follower 82 into engagement with the corresponding high lift cam lobe 38.

The rigid link 80 is pivotally supported at its ends by the lash adjuster 62 and the valve 14, while the rigid link 88A is pivotally supported at its ends by the lash adjuster 66 and the valve 16. The rigid link 80 includes one end portion 92 to drivingly engage an end portion of the valve stem portion 24 and an opposite end portion 94 to pivotally receive a hemispherical end 96 of a piston 98 of the lash adjuster 62 (see FIG. 3), and two rail portions 100 and 102. The rail portions 100 and 102 rigidly interconnect the end portions 92 and 94, and define surface portions or cam follower surfaces 104 and 106 which drivingly engage the low lift cams lobes 34 and 36 of the camshaft 30. The rigid link 80A includes one end portion 92A to drivingly engage an end portion of the valve stem portion 26 and an opposite end portion 94A to pivotally receive a hemispherical end of a piston of the lash adjuster 66, and two rail portions 100A and 102A. The rail portions 100A and 102A rigidly interconnect the end portions 92A and 94A, and define surface portions or cam follower surfaces 104A and 106A which drivingly engage the low lift cams lobes 40 and 42 of the camshaft 30.

The free cam follower 82 is disposed between the two rail portions 100 and 102 and cooperates with the high lift cam lobe 38, while the free cam follower 82A is disposed between the two rail portions 100A and 102A and cooperates with the high lift cam lobe 44. As seen from FIG. 3, the free cam follower 82 is pivotally hinged to the link 80 by the pin 84 having ends pressed through alinged holes 108 and 110 of the rail portions 100 and 102. Similarly, the free cam follower 82A is pivotally hinged to the link 80A by the pin 84A having end pressed through aligned holes 108A and 110A of the rail portions 100A and 102A.

As viewed in FIG. 3, the right end of the free cam follower 82 includes a notched portion having a downwardly facing surface 112 and a rightwardly and downwardly facing surface 114. The lost motion mechanism 90 includes a rightwardly and upwardly facing curved surface or pedestal surface portion 116 defined by the opposite end portion 94, a bore 118 of the free cam follower 82, a prop 120 and a lost motion spring 122 disposed in the bore 118. The prop 120 is retractably received in the bore 118 and has a hemispherical end engaging the pedestal surface portion 116. Owing to the lost motion spring 122, the free cam follower 82 is biased into engagement with the high lift cam lobe 38. The prop 120 is of a cylinder closed by the hemispherical end. The hemispherical end is formed with a passage 124 for draining the bore 118 for ease of installation of the prop 120 and for smooth motion thereof.

Figure 4:
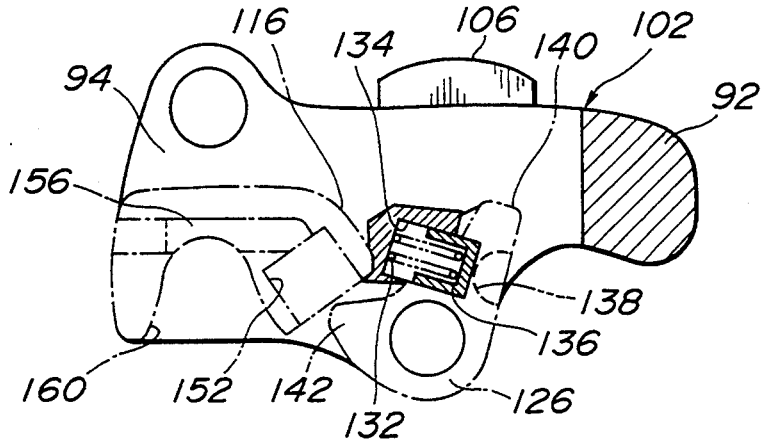
FIG. 4 is a sectoned rocker arm taken along the line 4—4 shown in FIG. 2.

Referring to FIGS. 2 and 3, the latch mechanism 86 includes a latch lever 126 pivotally hinged to the rigid link 80 by the pin 88, and the latch mechanism 86A includes a latch lever 126A pivotally hinged to the rigid link 80A by a pin 88A. The pin 88 has its ends pressed through alinged holes 128 and 130, and the pin 88A has its ends pressed through aligned holes 128A and 130A. The latch levers 126 and 126A are rotatably supported by the pins 88 and 88A. As readily seen from FIGS. 2 and 4, the latch mechanism 86 also includes a latch lever release spring 132 mounted in a bore 134 of the rail portion 102 for biasing the latch lever 126 clockwise as viewed in FIG. 3. As best seen in FIG. 4, a spring retainer 136 is slidably received in the bore 134 and thus carried by the rail portion 102, and has a flat top end slidably engages a hemispherical projection of an ear 138 projecting laterally from the latch lever 126. Likewise, a spring retainer 136A, carried by the rail portion 102A, slidably engages an ear 138A projecting laterally from the latch lever 126A. The latch lever 126 includes a radially extending portion having an upwardly facing surface 140 engageable with the downwardly facing surface 112 of the free cam follower 82, and the latch lever 126A includes a radially extending portion having an upwardly facing surface 140A engageable with the downwardly facing surface 112A of the free cam follower 82A (see FIG. 2). When the latch lever 126 is in the latched or first position as shown in FIG. 2 and as shown by dotted line in FIG. 3, the surfaces 140 and 112 engage to prevent movement of the free cam follower 82 relative to the rigid link 80. Similarly, when the latch lever 126A is in the latched position as shown in FIG. 2, the surfaces 140A and 112A engage to prevent movement of the free cam follower 82A relative to the rigid link 80A.

Referring to FIG. 3, the latch lever 126 has another radially extending protion with a rounded end 142 slidably engaging a hydraulic piston 150. The hydraulic piston 150 is slidably received in a bore 152 with which the opposite end portion 94 of the rigid link 80 is formed. The hydraulic piston 150 defines in the bore 152 a bore chamber 154. The opposite end portion 94 is formed with a passage 156 having one end communicating with the bore chamber 154 and an opposite end closed by a plug 158. The opposite end portion 94 is formed also with a recessed portion 160 having a window 162 opening into the passage 156. The recessed portion 160 receives the hemispherical end 96 of the lash piston 98. The hemispherical end 96 projects into the passage 156 through the window 162.

The lash piston 98 is hollowed and has an opposite end closed and sealed by an end plug 166. The hemispherical end 96 of the lash piston 98 is formed with a port 168 opening to the passage 156. The lash piston 98 defines a lash piston chamber 170 therein communicating with the passage 156. The hydraulic lash adjuster 62 includes, in addition to the lash piston 98, a lash cylinder 172 having one end closed. The lash cylinder 172 is disposed in the bore 64 of the cylinder head structure 18 and slidably receives the lash piston 98. Within the lash cylinder 172, disposed between the lash piston 98 and the closed end of the lash cylinder 172 is a sleeve-like member 174. The sleeve-like member 174 has an upper end engaging the end of the lash piston 98 and cooperates with the end plug 166 to define a chamber 176. The lower end of the sleeve-like member 174 is closed by an end plate 178. Disposed between the end plate 178 of the sleeve-like member 174 and the closed end of the lash cylinder 172 is a spring 180 for biasing the sleeve like-member 174 and the lash piston 98. In order t allow escape of hydraulic fluid from the chamber 176 to a spring accommodating chamber 182, a ball closes a valve port 186 with which the end plate 178 is formed. Supply of pressurized hydraulic fluid to the chamber 176 within the sleeve-like member 174 is effected by the common hydraulic fluid passage 70 of the cylinder head structure 18. Pressurized hydraulic fluid passes through an outer circumferential groove 188 and a port 190 of the lash cylinder 172, and an outer circumferential groove 192 and a port port 194 of the sleeve-like member 174. The lash cylinder 172 is formed also with another circumferential groove 196 and a radial port 198 opening to the groove 196. The radial port 198 communicates with an outer circumferential groove 200 of the lash piston 98. This outer circumferential groove 200 communicates via a radial port 202 with the lash piston chamber 170. The branch passage 74 extending from the common hydraulic fluid passage 72 of the head structure 18 has an end communicating with the circumferential groove 196 to selectively supply pressurized hydraulic fluid to the lash piston chamber 170 and then to the bore chamber 154 or drain the lash piston chamber 170 and the bore chamber 154. It should be noted that the lash piston chamber 170 is fluidly disposed between the common hydraulic fluid passage 72 of the cylinder head structure 18 and the passage 156 communicating with the bore chamber 154, thus forming a part of hydraulic fluid connection therebetween.

The lash adjusters 62 and 66 have the identical construction and play the idential role in the fluid connection between the common hydraulic fluid passage 72 of the cylinder head structure 18 and the bore chambers with which the opposite end portions 94 and 94A of the rigid links 80 and 80A are formed.

Although, not shown, the common hydraulic fluid passage 72 is associated with a solenoid, the engine cylinder block main gallery, and a drain port in the conventional manner. Briefly explaining, when the solenoid is not energized, the common hydraulic fluid passage 72 is drained via the drain port. When the solenoid is energized, the pressurized hydraulic fluid is supplied to the common hydraulic fluid passage 72.

When the bore chamber 154 is drained, the hydraulic piston 150 is the retracted position as shown in FIG. 3 owing to the bias of the latch lever release spring 132 and the latch lever 126 is in the latch released position as shown in FIG. 3, allowing motion of the free cam follower 82 relative to the rigid link 80. Thus, the low lift cam lobes 34 and 36 actuate the valve 14 in response to rotation of the camshaft 30.

When the bore chamber 154 is pressurized, the hydraulic piston 150 projects out of the bore 152 toward a position as shown by broken line in FIG. 3, causing pivotal counterclockwise motion of the latch lever 126 to the latched position as shown by the broken line in FIG. 3. When the latch lever 126 is in the latched position, the pivotal movement of the free cam follower 82 relative to the rigid link 80 is prevented, whereby the high lift cam lobe 38 actuates the valve 14 in response to rotation of the camshaft 30.

According to this embodiment, the first and second valves 14 and 16 are intake valves, respectively, arranged for one engine cylinder, and the common hydraulic fluid passage 72 is drained during relatively low engine speed and loading, while this passage 72 is su>-plied with pressurized hydraulic fluid during relatively high engine speed and loading. It should also be noted that the second pair of low lift cam lobes 40 and 42 have the height lower than the height of the first pair of low lift cam lobes 34 and 36 and are completely confined within the circumferential and radial extent of the profile of the first pair of low lift cam lobes 34 and 36 (see FIG. 3). Thus, when the first pair of low lift cam lobes 34 and 36 actuate the first intake valve 14 and the second pair of low lift cam lobes 40 and 42 actuate the second intake valve 16 in response to rotation of the camshaft 30 during relatively low speed and loading, a swirl is produced within the combustion chamber owing to the inflow of intake air past the intake valve 16.

In the previously described embodiment, the first and second high lift cam lobes 38 and 44 have the idential height and profile. If desired, the second high lift cam lobe 44 may be replaced with another high lift cam lobe which has a lower height than the height of the first high lift cam lobe 38 and is completely confined with the circumeferential and radial extent of the profile of the first high lift cam lobe 38. According to this modification, when the first high lift cam lobe 38 actuates the first intake valve 14 and the another high lift cam lobe actuate the second intake valve 16 in response to rotation of the camshaft 30 during relative high speed and loading, a swirl is produced within the combustion chamber owing to inflow of intake air past the second intake valve 16.

Figure 5:
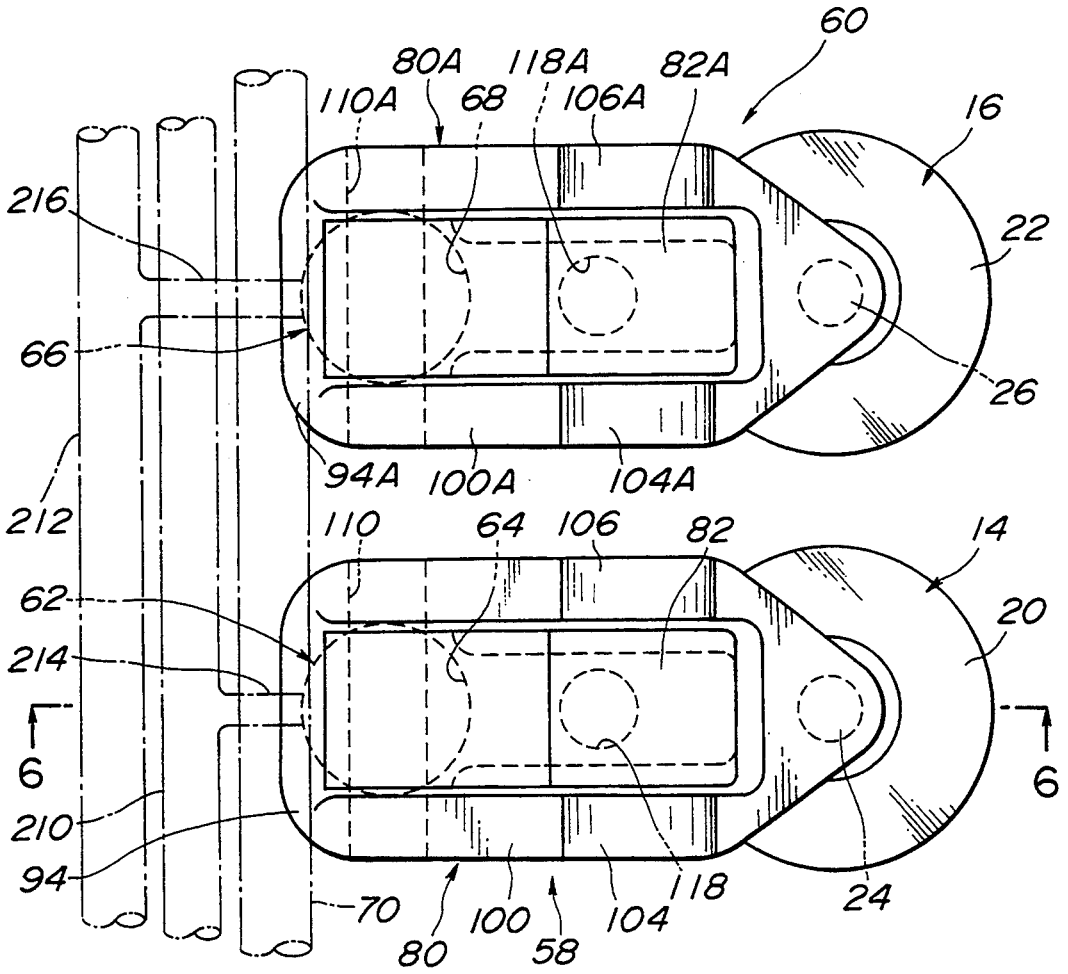
FIG. 5 is a similar view to FIG. 1, showing another embodiment.
Figure 6:
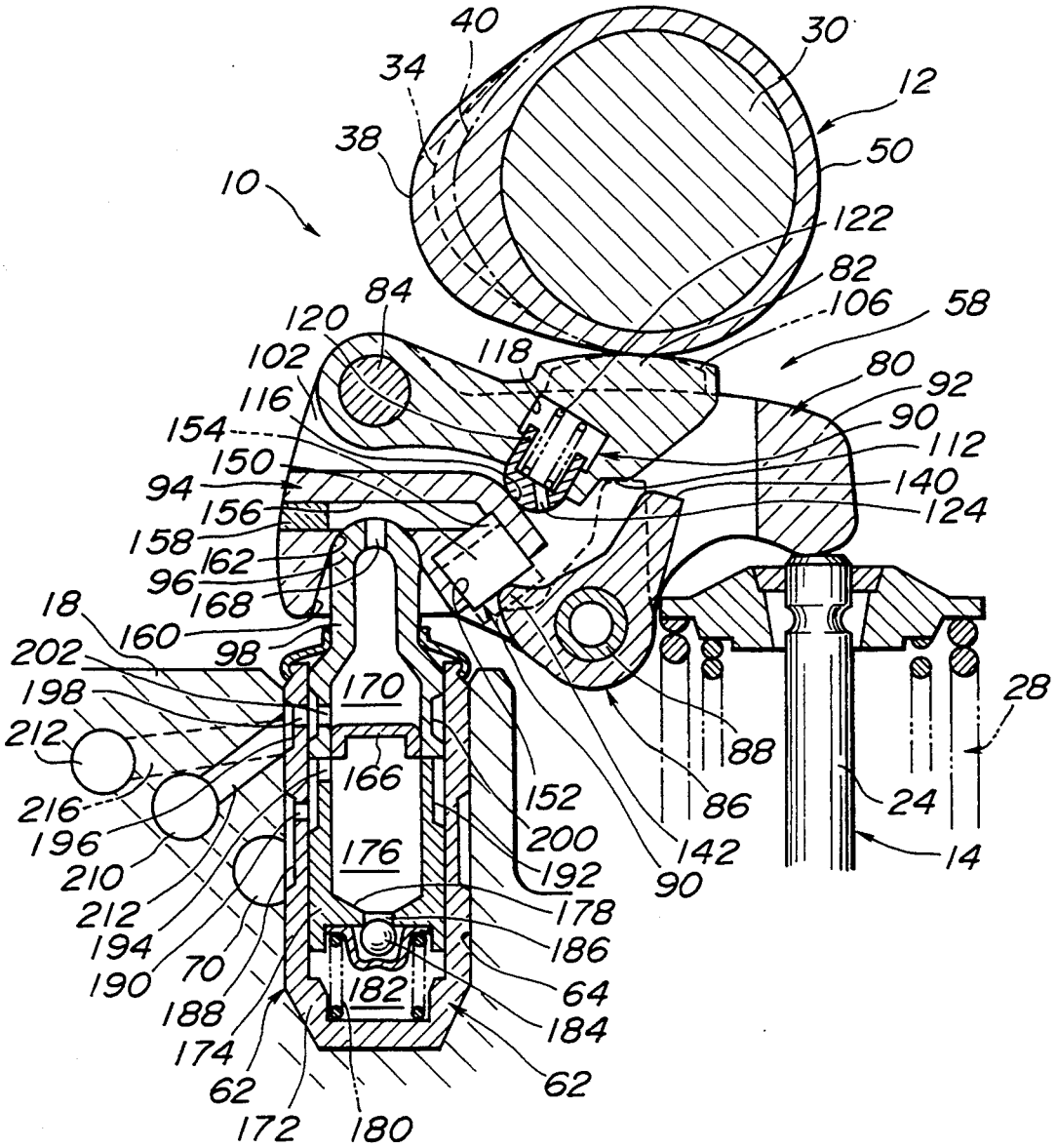
FIG. 6 is a sectioned view similar to FIG. 3 and taken along the line 6—6 shown in FIG. 5.

Referring to FIGS. 5 and 6, there is shown a second embodiment. This embodiment is substantially the same as the previously described embodiment. However, according to this embodiment, first and second rocker arms 58 and 60 are fluidly connected, respectively, to first and second hydraulic fluid passages 210 and 212 defined by a cylinder head structure 18. Specifically, the cylinder head structure 18 includes, in addition to the two hydraulic fluid passages 210 and 212, a branch passage 214 extending from the first hydraulic fluid passage 210 to a first lash adjuster mount bore 64 and a branch passage 216 extending from the second hydraulic fluid passage 212 to a second lash adjuster mount bore 68. Similarly to the previously described embodiment, a hydraulic lash adjuster 62 forms a fluid connection between the hydraulic fluid passage 210 and a bore chamber 154 defined by a hydraulic piston 150 carried by a first rocker arm 58 (see FIG. 6), and a hydraulic lash adjuster 66 forms a fluid connection between the fluid passage 212 and a bore chamber defined by a hydraulic piston carried by a second rocker arm 60.

Supply of pressurized hydraulic fluid to and discharge thereof from the hydraulic fluid passage 210 are independent from supply of pressurized hydraulic fluid to and discharge thereof from the hydraulic fluid passage 212.

A preferred control strategy is as follows:

During low engine speed and loading, both of the hydraulic fluid passages 210 and 212 are drained. In this phase, a first pair of low lift cam lobes 34 and 36 actuate a first valve 14 and a second pair of low lift cam lobes 40 and 42 actuate a second valve 16 in response to rotation of a camshaft 30.

During high engine speed and loading, both of the hydraulic fluid passages 210 and 212 are supplied with pressurized hydraulic fluid. In this phase, first and second high lift cam lobes 38 and 40 actuate the first and second valves 14 and 16 in response to rotation of the camshaft 30, respectively.

During intermediate engine speed and loading, the hydraulic fluid passage 210 is drained, while the hydraulic fluid passage 212 is supplied, with pressurized hydraulic fluid. In this phase, the first pair of low lift cam lobes 34 and 36 actuate the first valve 14, while the second high lift cam lobe 44 actuates the second valve 16 in response to rotation of the camshaft 30.

Referring to FIGS. 7 to 10, there is shown a third embodiment. This embodiment is similar to the previously described second embodiment shown in FIGS. 5 and 6.

Figure 8:
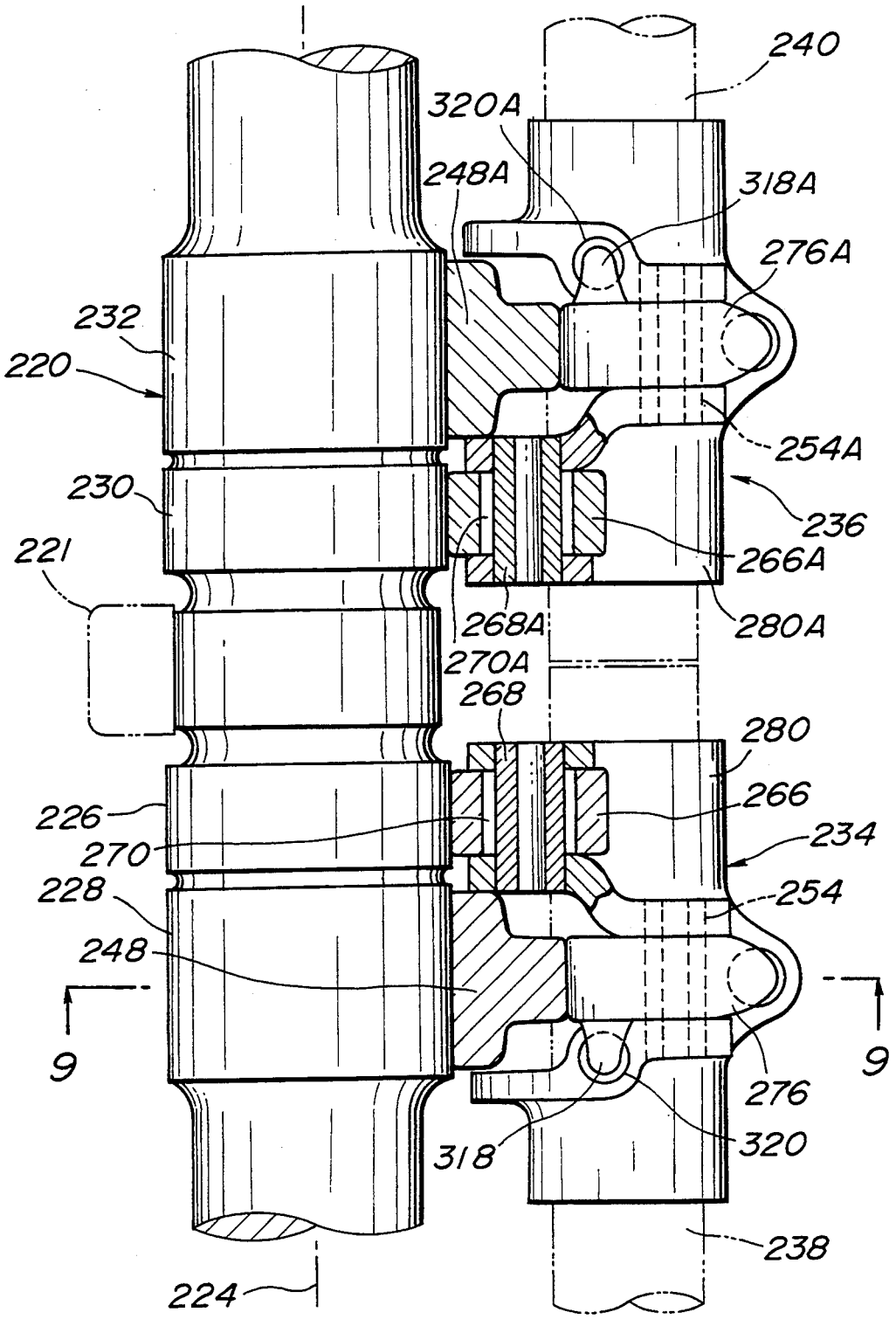
FIG. 8 is a sectioned view similar view to FIG. 2 and taken along the line 8—8 shown in FIG. 7.
Figure 9:
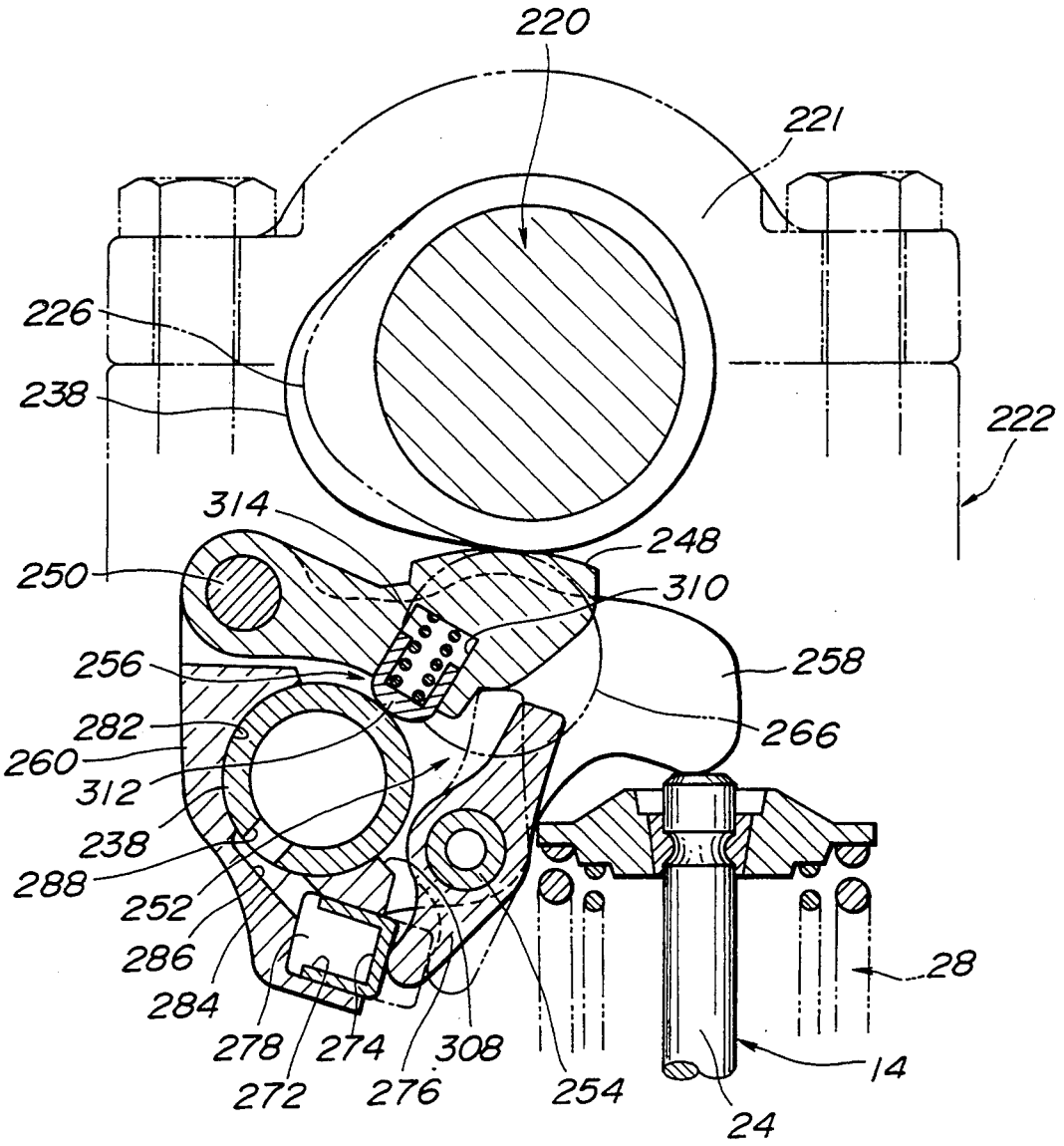
FIG. 9 is a sectioned view similar to FIG. 3 and taken along the line 9—9 shown in FIG. 8.

Referring particularly to FIGS. 8 and 9, a camshaft 220 is mounted by a cam bracket 221, in the conventional manner for rotation in a cylinder head structure 222. The camshaft 220 is rotatable about an axis 224. The camshaft 220 has a first low lift cam lobe 226 and a first high lift cam lobe 228 axially disposed adjacent to the first low lift cam lobe 226. The camshaft 220 has a second low lift cam lobe 230 and a second high lift cam lobe 232 axially disposed adjacent to the second low lift cam lobe 230. The first and second low lift cam lobes 220 and 230 are axially spaced, but interposed between the first and second high lift cam lobes 228 and 232.

Figure 7:
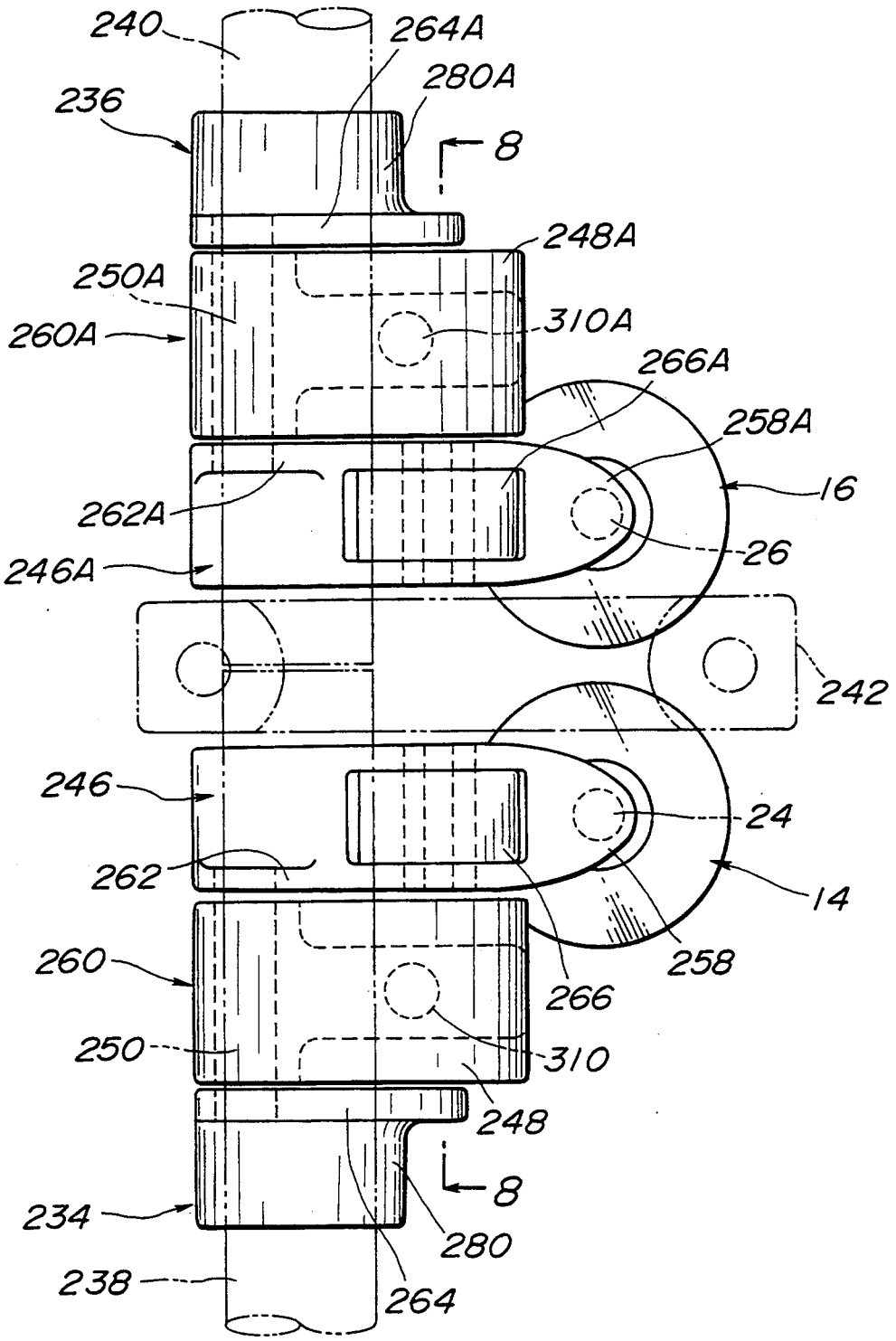
FIG. 7 is a similar view to FIG. 1, showing still another embodiment.
Figure 10:
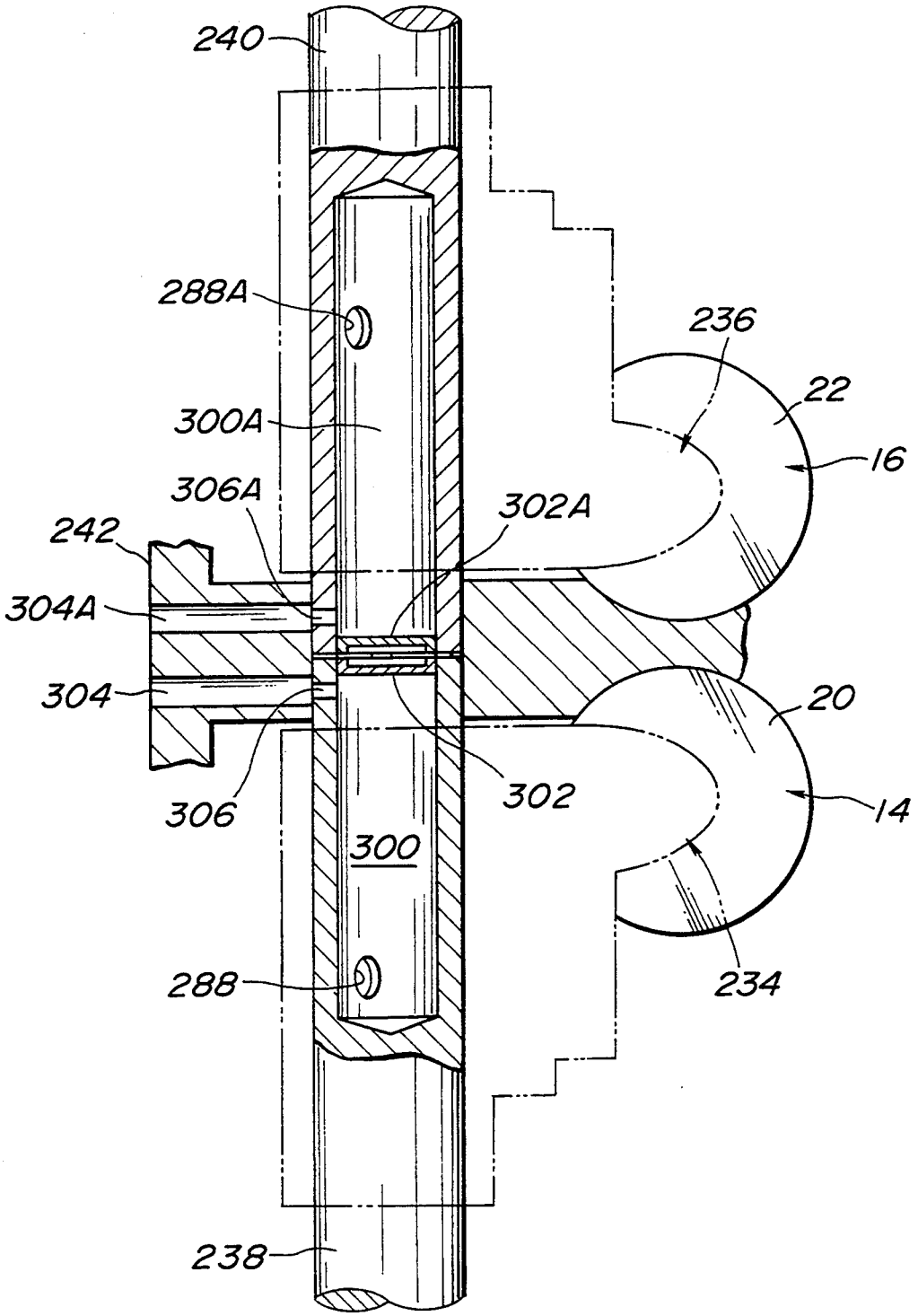
FIG. 10 is a view of rocker shafts partly 2O broken away to show fluid connections.

Referring to FIGS. 7 to 9, there are shown a first rocker arm 234 for actuating the first valve 14 and a second rocker arm 236 for actuating the second valve 16. The first rocker arm 234 is pivotally supported at one end by a first rocker shaft 238, while the second rocker arm 236 is pivotally supported at one end by a second rocker shaft 240. The first and second rocker shafts 238 and 240 are mounted in the engine cylinder head structure by means of a plurality of rocker shaft brackets, only one being shown at 242 in FIG. 10. As best seen in FIG. 10, the first and second rocker shafts 238 and 240 are aligned and have adjacent and opposed end portions supported by the rocker shaft bracket 242. As different from the embodiment shown in FIGS. 5 and 6, the first rocker shaft 238 and second rocker shaft 240 form fluid connections to the first and second rocker arms 234 and 236.

Referring to FIGS. 7 and 8, the first and second rocker arms 234 and 236 are in the mirror image relationship.

For brevity of description, the same reference numerals as used in denoting parts or portions of the first rocker arm 234 are used to denote the corresponding parts or portions of the second rocker arm 236 but with a suffix A.

As best seen in FIG. 9, the rocker arm 234 includes a rigid link 246, a free cam follower 248 pivotally hinged to the rigid link 246 at a portion adjacent to the corresponding rocker shaft 238 by a pin 250, a latch mechanism 252 carried by a pin 254 at a position adjacent to the corresponding valve 14 and selectively operative to prevent pivotal motion of the free cam follower 248 relative to the link 246, is a lost motion mechanism 256 for biasing the free cam follower 248 into engagement with the corresponding high lift cam lobe 228.

Referring to FIGS. 7 .and 8, the rigid link 246 includes one end portion 258 to drivingly engage an end portion of a valve stem 24 of the valve 14, an opposite end portion 260, a relatively long first rail portion 262 and a relatively short second rail portion 264. The first and second rails portions 262 and 264 are connected to the opposite end portion 260. The first rail portion 262 interconnects the one and opposite end portions 258 and 260 and carries a cam follower roller 266 drivingly engaging the first low lift cam lobe 226. As best seen in FIG. 8, the roller 266 is rotatably supported by a pin 268 via a bearing 270. The free cam follower 248 is disposed between the first and second rail portions 262 and 264 and drivingly engages the first high lift cam lobe 228.

Referring to FIG. 9, the opposite end portion 260 of the rigid link 246 is formed with a latch piston bore 272 receiving a hydraulic piston 274 for actuating a latch lever 276 of the latch mechanism 252. The latch lever actuating hydraulic piston 274 defines in the bore 272 a bore chamber 278. Referring also to FIGS. 7 and 8, the opposite end portion 260 includes a sleeve 280 defining a bearing bore 282 receiving therein the corresponding rocker shaft 238. The axial length of the sleeve 180 and its axis position relative to the first and second rails portions 262 and 264 are so determined as to restrain inclination of the corresponding rocker arm 234 to ensure smooth motion thereof in response to rotation of the camshaft 220.

For fluid connection with the bore chamber 278, the bearing bore defining wall is formed with an opening 284. The opposite end portion 260 is also formed with a passage 286 having one end communicating with the bore chamber 278 and an opposite end terminating at the above-mentioned opening 284. As best seen in FIG. 9, the rocker shaft 238 is formed with a radial port 288 always communicating with the opening 284 during the pivotal motion of the rocker arm 234. This radial port 288 communicates with an axial passage 300 with which the rocker shaft 238 is formed.

Referring to FIG. 10, the first and second rocker shafts 238 and 240 are formed with blind ended bores having their open ends opposed to each other and closed by end plugs 302 and 302A. Thus, the first rocker shaft 238 defines the axial passage 300, and the second rocker shaft defines an axial passage 300A. The rocker shaft bracket 242 defines two fluid passages, namely a first passage 304 and a second passage 304A. The first and second rocker shafts 238 and 240 are formed with first and second inlet ports 306 and 306A for establishing a fluid communication between the first passage 304 and the axial passage 300 and a fluid communication between the second passage 304A and the axial passage 300A. The first and second passages 304 and 304A are independent and selectively supplied with pressurized hydraulic fluid from a main gallery of the engine cylinder block or drained.

From the preceding description, it should be noted that two independent fluid connections to the first and second rocker arms 234 and 236 are established through two rocker shafts 238 and 240.

Referring to FIG. 9, the opposite end portion 260 is formed with a window 308 at a portion below the free cam follower 248 to expose the outer cylindrical surface of the rocker shaft 238. The lost motion mechanism 256 includes this outer cylindrical surface, a bore 310 the free cam follower 248, a prop 312 and a lost motion spring 314 disposed in the bore 310. Owing to the lost motion spring 314, the prop 312 biases the free cam follower 248 into engagement with the high lift cam lobe 228. It should be noted that the prop 312 is in slidable engagement with the outer cylindrical surface of the rocker shaft 238.

As best seen in FIG. 8, the latch lever 276 has a laterally projected ear 318 for engagement with a spring retainer 320 for a latch lever release spring, not shown, mounted in bore of the second rail portion 264. Likewise, the latch lever 276A has a laterally projected ear 318A for engagement with a spring retainer 320A for a latch lever release spring, not shown, mounted in bore of the second rail portion 264A. The latch mechanism 252, hydraulic piston 274 and free cam follower 248 are operatively interrelated in the same manner as their counterparts of the previously described embodiment are. Thus detailed description is hereby omitted.

Figure 11:
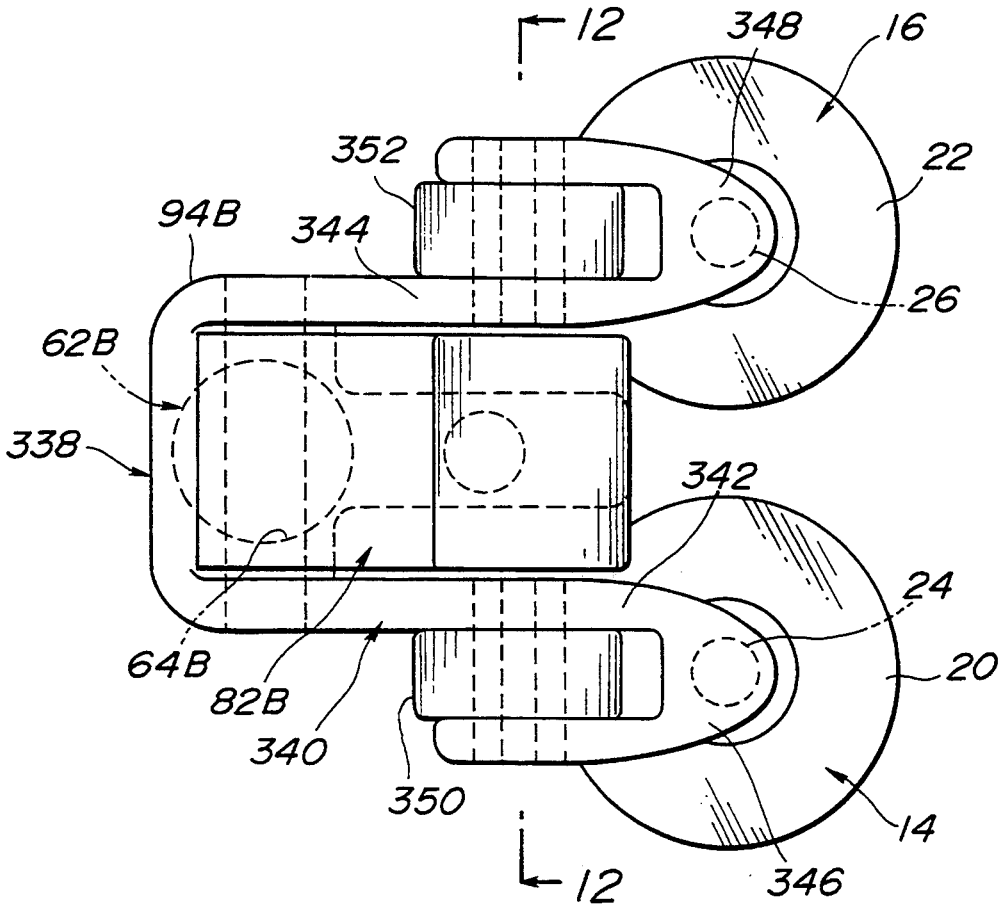
FIG. 11 is a similar view to FIG. 1, showing a further embodiment.
Figure 12:
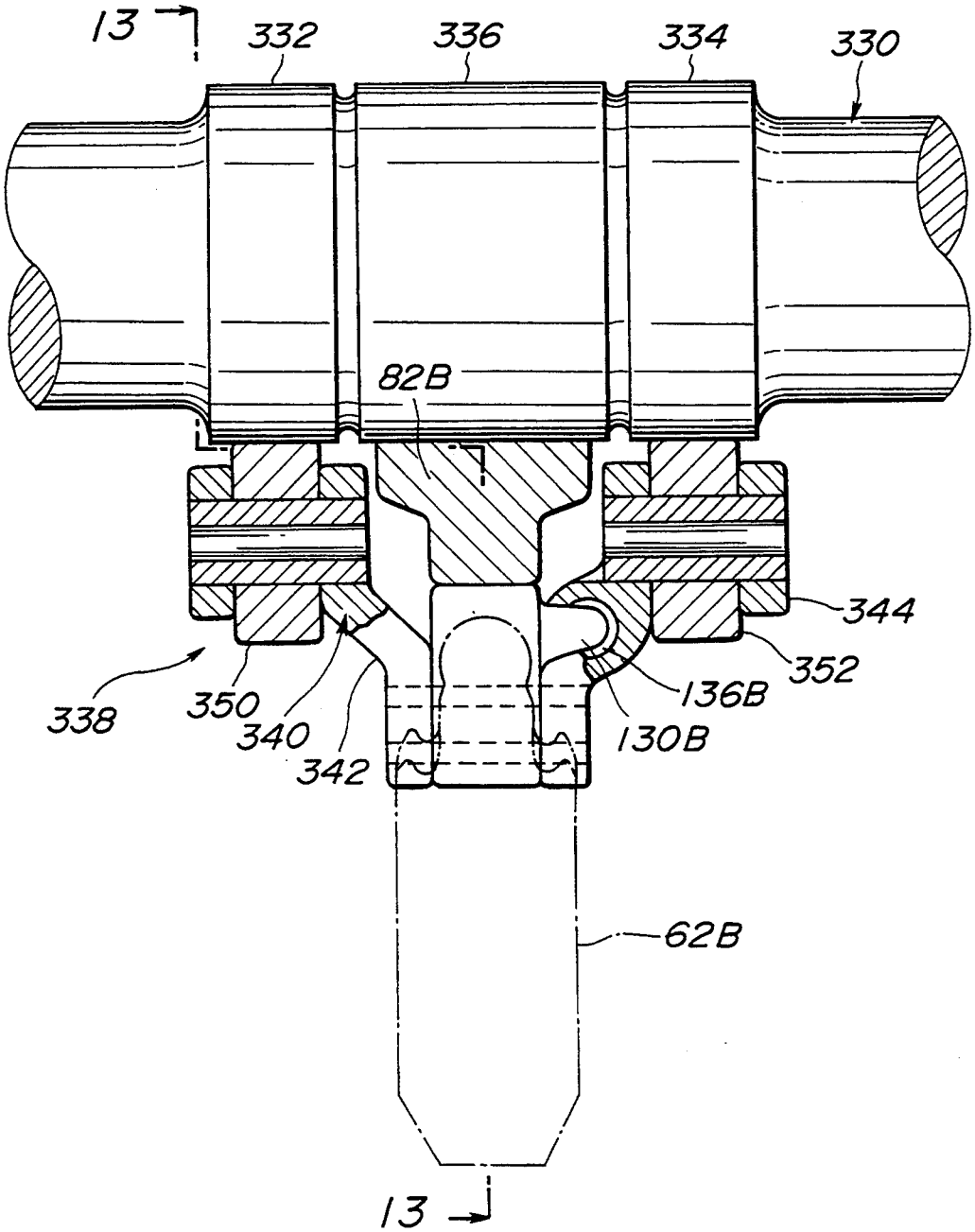
FIG. 12 is a sectioned view similar to FIG. 2 and taken along the line 12—12 shown in FIG. 11.
Figure 13:
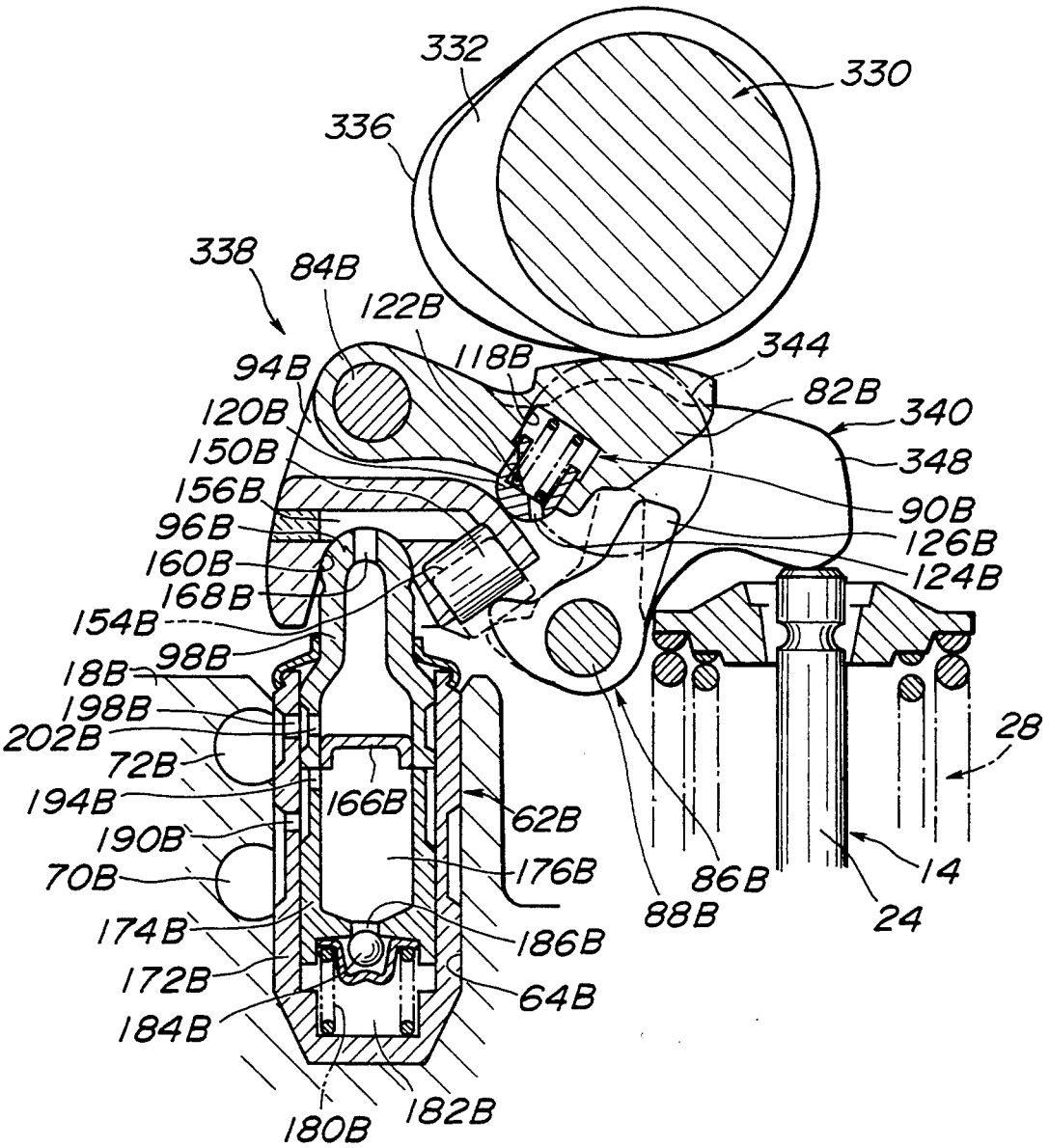
FIG. 13 is a sectioned view similar to FIG. 3 and taken along the line 13—13 shown in FIG. 12.

Referring to FIGS. 11 to 13, there is shown a third embodiment. This third embodiment is similar to the first embodiment shown in FIGS. 1 to 4 in that a rocker arm is pivotally supported by a hydraulic lash adjuster an a fluid connection to a hydraulic piston for actuating a latch mechanism is established through the hydraulic lash adjuster. However, the third embodiment is different from the first embodiment in that the single rocker arm actuates first and second valves for one cylinder in response to rotation of a camshaft.

Referring to FIG. 12, a camshaft 330 has a pair of axially spaced low lift cam lobes 332 and 334 and a high left cam lobe 336 axially disposed between the pair of low lift cam lobes 332 and 334. Referring also to FIGS. 11 and 13, a rocker arm 338 is pivotally supported at one end by a hydraulic lash adjuster 62B contained in a bore 64B defined in a cylinder head structure 18B. The head structure 18B includes, in addition to the bore 64B, a common hydraulic fluid passage 70B for supplying pressurized hydraulic fluid to the hydraulic lash adjuster 62B, and a hydraulic fluid passage 72B for supplying pressurized hydraulic fluid to or draining the rocker arm 338.

Since FIG. 13 is similar to FIG. 3, the same reference numerals as used in denoting parts or portions in FIG. 3 are used in FIG. 13 in denoting their counterparts but with the suffix B.

The rocker arm 338 includes an elongated rigid link 340, a free cam follower 82B pivotally hinged to the rigid link 340 at a position adjacent to the lash adjuster 62B by a pin 84B, a latch mechanism 86B carried by a pin 88B at a position adjacent to valves 14 and 16 and selectively operative to prevent pivotal movement of the free cam follower 82B relative to the link 340, a lost motion mechanism 90B for biasing the free cam follower 82B into engagement with the high lift cam lobe 336.

The rigid link 340 includes a pair of rail portions 342 and 344 having one end portions 346 and 348 to drivingly engage respective end portions of valve stems 24 and 26 of the valves 14 and 16. The link 340 also includes an opposite end portion 94B interconnecting the opposite end portions of the pair of rail portions 342 and 344. The free cam follower 82B is disposed between the pair of rail portions 342 and 344.

The pair of rail portions 342 and 344 rotatably carry cam follower rollers 350 and 352 which drivingly engage the low lift cam lobes 332 and 334, respectively. As seen in FIG. 12, a latch lever 126B has a laterally projecting ear 130B engaging a spring retainer 136B carried by the rail portion 344.

What is claimed is:

1. An internal combustion engine, comprising:

a cylinder head structure;

a first cylinder valve mounted in said cylinder head structure;

first resilient means for biasing said first cylinder valve towards a closed position thereof;

a second cylinder valve mounted in said cylinder head structure;

second resilient means for biasing said second cylinder valve towards a closed position thereof;

said first and second cylinder valves being arranged for one cylinder of the engine;

a camshaft mounted for rotation in said cylinder head structure, said camshaft being rotatable about an axis;

a first rocker arm mounted in said cylinder head structure for pivotal motion to actuate said first cylinder valve against said first resilient means in response to rotation of said camshaft;

a first free cam follower supported by said first rocker arm for pivotal motion relative to said first rocker arm in response to rotation of said camshaft;

a first latch mechanism having a first position wherein said pivotal motion of said first free cam follower relative to said first rocker arm is prevented and a second position wherein said pivotal motion of said first free cam follower relative to said first rocker arm is allowed;

first hydraulic means for urging said first latch mechanism from said second position thereof towards said first position thereof;

a second rocker arm mounted in said cylinder head structure for pivotal motion to actuate said second cylinder valve against said second resilient means in response to rotation of said camshaft;

a second free cam follower supported by said second rocker arm for pivotal motion relative to said second rocker arm in response to rotation of said camshaft;

a second latch mechanism having a first position wherein said pivotal motion of said second free cam follower relative to said second rocker arm is prevented and a second position wherein said pivotal motion of said second free cam follower relative to said second rocker arm is allowed;

second hydraulic means for urging said second latch mechanism from said second position thereof towards said first position thereof;

wherein said camshaft has a first pair of low lift cam lobes, and a first high lift cam lobe axially disposed between said first pair of low lift cam lobes, and wherein said camshaft also has a second pair of low lift cam lobes, and a second high lift cam lobe axially disposed between said second pair of low lift cam lobes, said second pair of low lift cam lobes having the height lower than the height of the first pair of low lift cam lobes and being completely confined with the circumferential and radial extent of the first pair of low lift cam lobes;

wherein said first rocker arm includes a first elongated rigid link, said first rigid link including one end portion to drivingly engage said first cylinder valve, an opposite end portion, and two rail portions rigidly interconnecting said one and opposite end portions, said two rail portions of said first rigid link defining cam follower surfaces drivingly engaging said first pair of low lift cam lobes, and wherein said first free cam follower is disposed between said two rail portions of said first rigid link and drivingly engages said first high lift cam lobe;

wherein aid second rocker arm includes a second elongated rigid link, said second rigid link including one end portion to drivingly engage said second cylinder valve, an opposite end portion, and two rail portions rigidly interconnecting said one and opposite end portions of said second rigid link, said two rail portions of said second rigid link defining cam follower surfaces drivingly engaging said second pair of low lift cam lobes, and wherein said second cam follower is disposed between said two rail portions of said second rigid link and drivingly engages said second high lift cam lobe;

wherein said cylinder head structure is formed with a common hydraulic fluid passage-communicating with said first and second hydraulic means, and wherein said cylinder head structure is formed with axially spaced first and second lash adjuster mount bores with respect to the axis of rotation of said camshaft, said first and second lash adjuster mount bores being in fluid communication with said common hydraulic fluid passage;

further comprising a first hydraulic lash adjuster including a moveable portion and a second hydraulic lash adjuster including a moveable portion, said first and second hydraulic lash adjusters being mounted in said first and second lash adjuster mount bores of said cylinder head structure, respectively; and wherein said moveable portion of said first hydraulic lash adjuster defines a hydraulic fluid passage fluidly disposed between said common hydraulic fluid passage and said first hydraulic fluid means to provide fluid communication therebetween, and said moveable portion of said second hydraulic lash adjuster defines a hydraulic fluid passage fluidly disposed between said common hydraulic fluid passage and said second hydraulic fluid means to provide fluid communication therebetween.

* * * * *